US006701884B2

(12) United States Patent
Schneider et al.

(10) Patent No.: US 6,701,884 B2
(45) Date of Patent: Mar. 9, 2004

(54) CAM END COVER AND GASKET ASSEMBLY

(75) Inventors: Andreas Schneider, Leonberg (DE); Klaus Fuoss, Balingen (DE); Jeffrey P. Coughlin, Pewaukee, WI (US)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 0 days.

(21) Appl. No.: 10/138,054

(22) Filed: May 3, 2002

(65) Prior Publication Data

US 2002/0166534 A1 Nov. 14, 2002

(30) Foreign Application Priority Data

May 5, 2001 (DE) ..... 101 21 947

(51) Int. Cl.[7] ..... F02F 1/00
(52) U.S. Cl. ..... 123/195 C
(58) Field of Search ..... 123/195 C, 193.5, 123/90.27, 90.38, 90.31, 90.37, 198 E; 277/592, 593, 594, 595

(56) References Cited

U.S. PATENT DOCUMENTS 3,625,527 A 12/1971 Brindle
4,227,705 A * 10/1980 Kuramoto ..... 123/90.37
4,396,200 A * 8/1983 Ukai et al. ..... 277/598
4,951,623 A * 8/1990 Jingu et al. ..... 123/193.5
4,970,999 A 11/1990 Jingu et al.
5,199,721 A 4/1993 Schmitt

FOREIGN PATENT DOCUMENTS

JP 63094059 A * 4/1988 ..... F02F/7/00
JP 08218817 A * 8/1996 ..... F01L/1/04

* cited by examiner

*Primary Examiner*—Tony M. Argenbright
*Assistant Examiner*—Hyder Ali
(74) *Attorney, Agent, or Firm*—Michael Best & Friedrich LLP

(57) ABSTRACT

An overhead cam motorcycle engine includes a cylinder head, a cam cover coupled to the cylinder head, a sealing gasket, and a substantially rigid insert. The cylinder head includes an aperture that is substantially axially aligned with an engine camshaft axis. The resilient gasket includes a sealing jacket that defines an opening. The gasket is positioned between the cylinder head and the cam cover such that the sealing jacket occupies the aperture. The insert is positioned in the opening in the sealing jacket to seal the cylinder head and cam cover interface.

32 Claims, 5 Drawing Sheets

CAM END COVER AND GASKET ASSEMBLY

FIELD OF THE INVENTION

The invention relates to motorcycles, and more particularly to motorcycles having overhead cam engines.

BACKGROUND OF THE INVENTION

The use of overhead cam engines, and more particularly dual overhead cam engines, is well known in the motorcycle industry. Tolerance limits on the casting process used to form the cylinder head of an overhead cam engine make it necessary to ream the cam shaft bearing seats, which are integrally cast into the cylinder head. The reaming ensures the proper alignment and rotation of the camshafts inside the cam case. In order to ream the bearing seats in the relatively confined cylinder head casting, it is necessary to first cast or machine a semi-circular recess in the side wall of the cylinder head and in alignment with the bearing seats. The reaming bit then has an unobstructed path to perform its operation. Aside from facilitating the reaming operation, the semi-circular recess in the cylinder head serves no purpose and must be closed off when the cam cover is placed on the cylinder head.

Prior art dual overhead cam engines typically include a resilient sealing gasket at the split line between the cylinder head and the cam cover. The sealing gasket includes integral semi-circular or "half-moon" cam end cover portions that fit in the semi-circular recesses so that the cylinder head and the sealing gasket together form a substantially flat and continuous upper peripheral edge. The cam cover, which has a flat lower peripheral edge corresponding in shape to the upper peripheral edge of the sealing gasket, is then mounted on the cylinder head to enclose the cam shafts and define the upper portion of the cam case. The sealing gasket substantially seals the joint between the cylinder head and the cam cover.

SUMMARY OF THE INVENTION

Prior art cam case sealing gaskets suffer from various problems. The half-moon cam cover portions are typically molded from the same resilient, elastomeric material as the remainder of the sealing gasket. Because of their resilience, the cam end cover portions often provide a less than adequate seal between the cylinder head and the cam cover. Typically, silicone or other sealing materials must be used on the cam end cover portions, the cam cover, or both prior to mounting the cam cover on the cylinder head to ensure that the semi-circular recesses remain properly sealed. The sealing material may also need to be re-applied each time the cam cover is removed and then re-assembled. The elastomeric half-moon cam cover portions also tend to lack aesthetic appeal.

The present invention provides a motorcycle including a frame, an engine crankcase and cylinder assembly coupled to the frame, a cylinder head coupled to the crankcase and cylinder assembly, a cam cover coupled to the cylinder head, and a substantially rigid insert. The cylinder head includes a camshaft support surface and a cylinder head wall. The camshaft support surface defines a camshaft axis and the cylinder head wall partially defines an aperture that is substantially axially aligned with the camshaft axis. The cam cover cooperates with the cylinder head wall to further define the aperture, and the insert is positioned in the aperture.

The aperture includes a first boundary that is defined by the cylinder head, and a second boundary that is defined by the cam cover, and the insert includes a first profile corresponding to the first boundary, and a second profile corresponding to the second boundary. In some embodiments, the first and second profiles cooperate to define a semi-circular inner portion of the insert. In other embodiments, the first and second profiles cooperate to define a circular inner portion of the insert.

The motorcycle may also include a sealing jacket that surrounds the insert and engages the cylinder head and the cam cover. The sealing jacket may be integrally formed with a resilient sealing member that is positioned between the cylinder head and the cam cover. The insert may also include a substantially circular outer portion that overlies portions of the cylinder head wall and the cam cover.

The present invention also provides a method for sealing an interface between a cylinder head and a cam cover. The cylinder head includes a camshaft support surface that defines a camshaft axis, and a cylinder head wall that defines an aperture. The aperture is adjacent the interface and is substantially aligned with the camshaft axis. A substantially rigid insert is provided and a resilient sealing member including a resilient sealing jacket is positioned around the insert. The resilient sealing member is located between the cylinder head and the cam cover such that the resilient sealing jacket and the insert occupy the aperture.

The present invention also provides a method of making a sealing gasket and insert assembly for an overhead cam motorcycle engine. The method includes providing a rigid insert and a continuous sealing gasket that includes a sealing jacket defining an opening. The sealing gasket is positioned around the insert such that the insert is positioned in the opening and the sealing jacket substantially surrounds and retains the insert. The gasket may be molded around the insert or alternatively the insert may be pressed into the opening.

The present invention also provides a method for replacing a substantially rigid old insert having an inner portion received by an opening in a sealing gasket. The sealing gasket is positioned in an interface between a cylinder head and a cam cover of an overhead cam motorcycle engine, and the old insert has an outer portion overlying portions of the cylinder head and the cam cover. The method includes providing a substantially rigid replacement insert including an inner portion that is positionable within the opening. The old insert is removed from the opening; and the replacement insert is inserted into the opening. A replacement sealing gasket including an opening may also be provided and the replacement sealing gasket may be positioned in the interface in place of the original gasket.

The present invention also provides a method for replacing a sealing gasket positioned in an interface between a cylinder head and a cam cover of an overhead cam motorcycle engine. The sealing gasket includes an opening that receives an inner portion of a substantially rigid insert, and the insert has an outer portion overlying portions of the cylinder head and the cam cover. The method includes decoupling the cam cover from the cylinder head and removing the sealing gasket from the interface. The insert is removed from the sealing gasket opening and a replacement sealing gasket including an opening configured to receive the inner portion of the insert is provided. The inner portion of the insert is inserted into the opening of the replacement gasket, the replacement gasket is positioned in the interface, and the cam cover is recoupled to the cylinder head.

Other features and advantages of the invention will become apparent to those skilled in the art upon review of the following detailed description, claims, and drawings.

Figure 1:
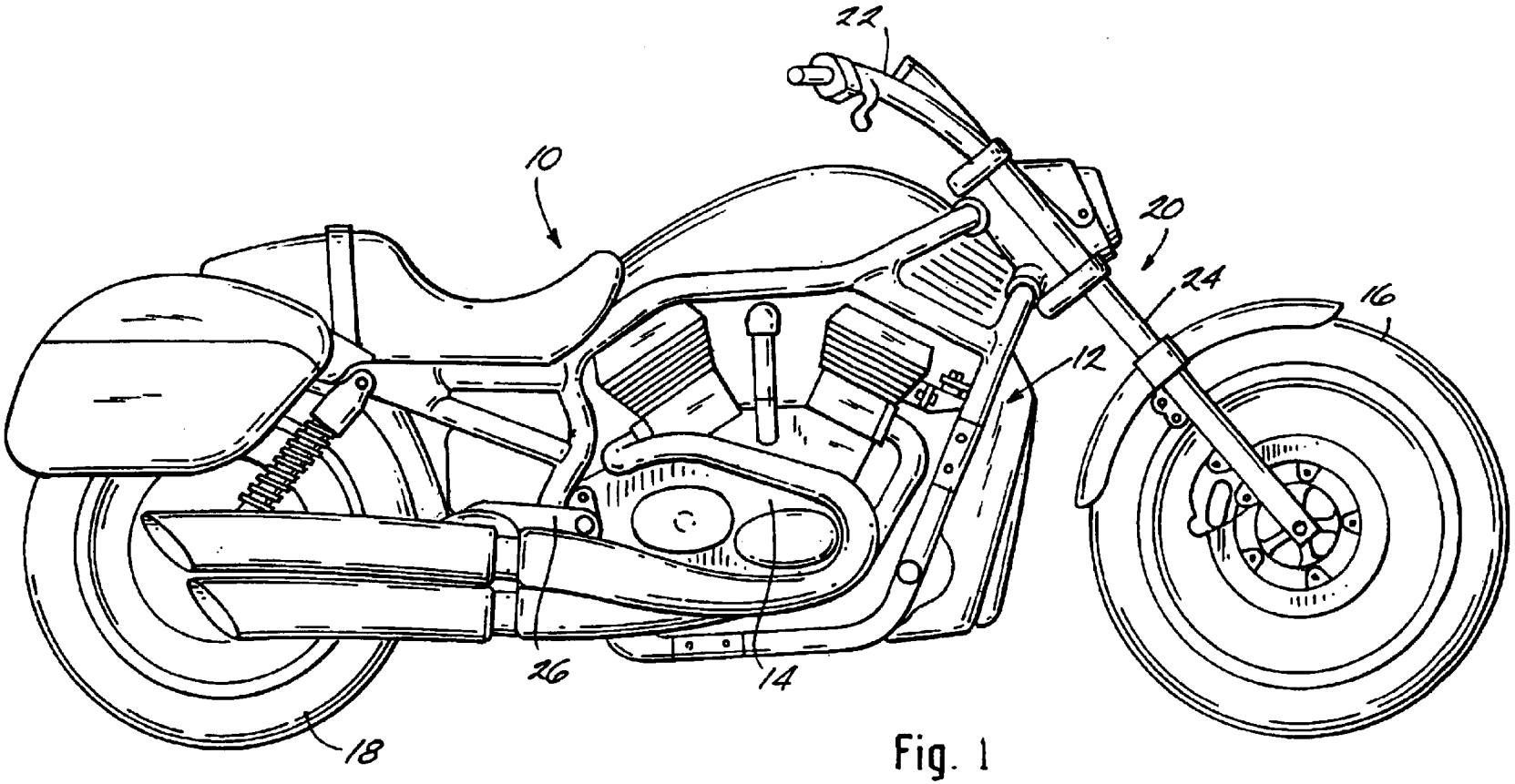
FIG. 1 is a side elevation view of a motorcycle embodying the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

FIG. 1 illustrates a motorcycle 10 including a frame 12, an overhead cam internal combustion engine assembly 14 mounted to the frame 12, front and rear wheels 16, 18 supporting the frame 12, a steering assembly 20 including handlebars 22 and a fork 24 mounted to the front wheel 16 and pivotal with respect to the frame 12, and a swing arm 26 (partially hidden) interconnecting the rear wheel 18 to the frame 12.

Figure 2:
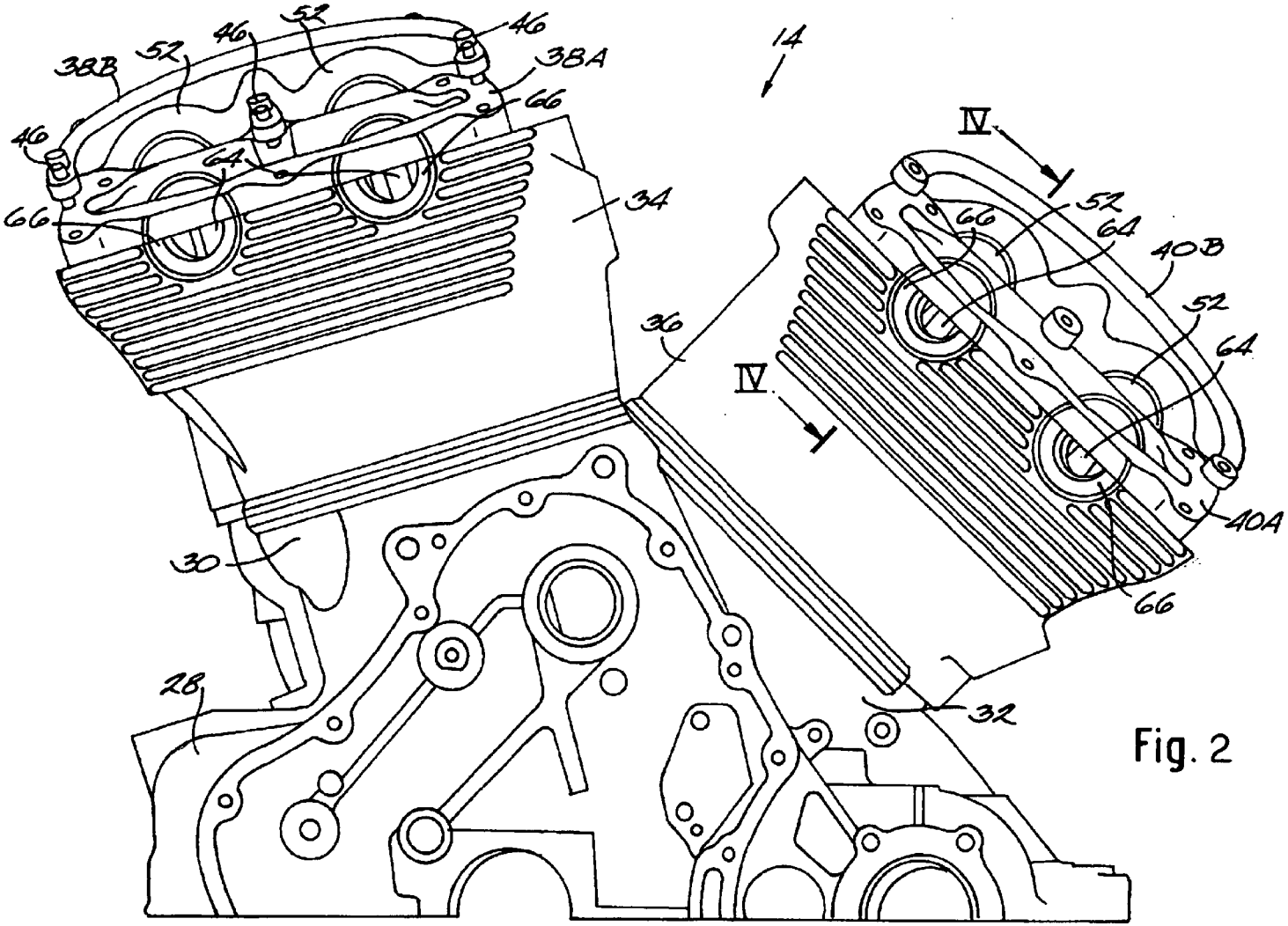
FIG. 2 is a side view of an internal combustion engine with a portion cut away.
Figure 3:
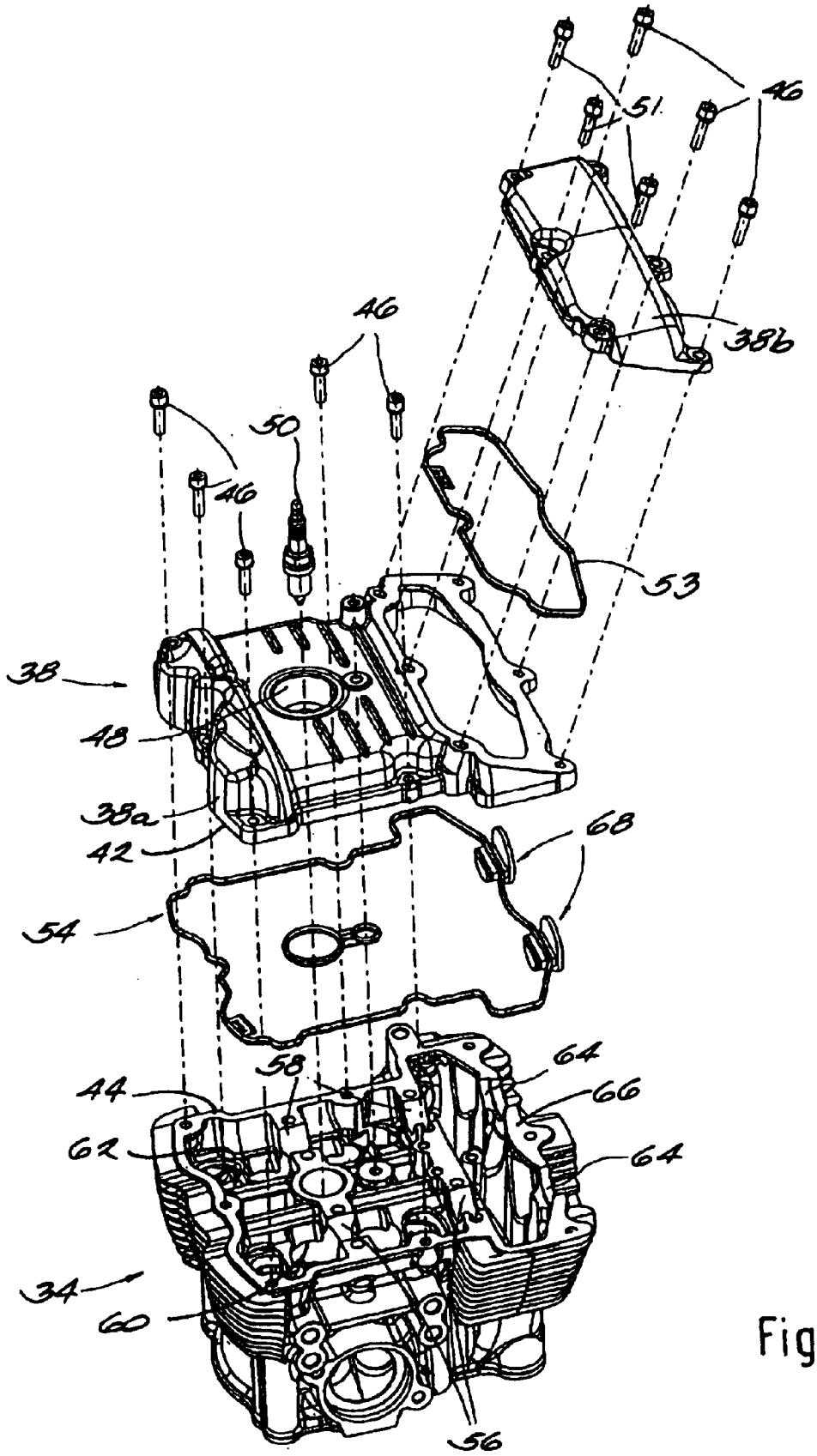
FIG. 3 is an exploded view of a cylinder head and cam cover of the internal combustion engine.

Referring to FIGS. 2 and 3, the illustrated engine assembly 14 is configured as a V-twin engine and includes an upper crankcase portion 28 having integrally-formed engine cylinders 30, 32 that receive engine pistons (not shown). Cylinder heads 34, 36 are secured to the engine cylinders 30, 32 respectively and house various valve drive components for the internal-combustion engine 14. In the illustrated embodiment, intake and exhaust camshafts as well as spring-loaded intake and exhaust valves (not shown) are positioned in each cylinder head 34, 36 (only the cylinder head 34 being shown in FIG. 3). The intake and exhaust camshafts engage cam followers to actuate the valves in a known manner.

The cylinder heads 34, 36 cooperate with respective cam covers 38, 40 to define a cam case or chamber, the cylinder heads 34, 36 forming the lower portion of the cam case, and the cam covers 38, 40 forming the upper portion of the cam case. The illustrated cam covers 38, 40 are constructed of two parts and include base covers 38*a*, 40*a*, and cam gear covers 38*b*, 40*b*. The base covers 38*a*, 40*a* include a lower peripheral edge 42 that is configured to mate with an upper peripheral edge 44 of a respective cylinder head 34, 36 to define a cam case interface. The cam covers 38, 40 are fastened to the cylinder heads 34, 36 with suitable bolts 46. In addition, an opening 48 configured to receive a spark plug 50 is also formed in each base cover 38*a*, 40*a*. The cam gear covers 38*b*, 40*b* are secured to the base covers 38*a*, 40*a* by the bolts 46, which also secure the entire cam covers 38, 40 to the cylinder heads 34, 36, as well as by additional bolts 51, which generally extend only into the base covers 38*a*, 40*a*. The cam gear covers 38*b*, 40*b* include arcuate chamber portions 52 that receive driving gears for the camshafts. A resilient seal 53 is positioned between the base covers 38*a*, 40*a* and the cam gear covers 38*b*, 40*b*. Some embodiments of the invention include cam covers 38, 40 that are integrally formed as one piece and include the structural features of both the base covers 38*a*, 40*a* and the cam gear covers 38*b*, 40*b*.

With respect to the features described further below, the construction and arrangement of the cylinder heads 34, 36 and the cam covers 38, 40 are substantially the same. As such, the following description will be presented only with respect to one cylinder head 34 and one cam cover 38. A resilient sealing gasket 54 is positioned between the upper peripheral edge 44 of the cylinder head 34 and the lower peripheral edge 42 of the cam cover 38 to seal the interface. Formed in the cylinder head 34 are two sets of camshaft support surfaces 56, 58 that are configured to rotatably support the camshafts. The support surfaces 56, 58 are generally semi-circular and define camshaft axes 60, 62. The camshaft support surfaces 56, 58 must be precisely formed and are therefore machined into the cylinder head 34 using suitable boring or milling tools. In order to machine the bearing support surfaces 56, 58, apertures 64 are provided in a cylinder head wall 66. The apertures 64 are each aligned with a respective camshaft axis 60, 62 such that the machine tools may be extended through the apertures 64 to machine the camshaft support surfaces 56, 58. As illustrated, the apertures 64 are substantially semi-circular and generally define recesses in, and have arcuate boundaries defined by, the upper peripheral edge 44 of the cylinder head 34. In addition, the lower peripheral edge 42 of the cam cover 38 defines additional substantially linear boundaries of the apertures 64 when the cam cover 38 is coupled to the cylinder head 34.

Figure 4:
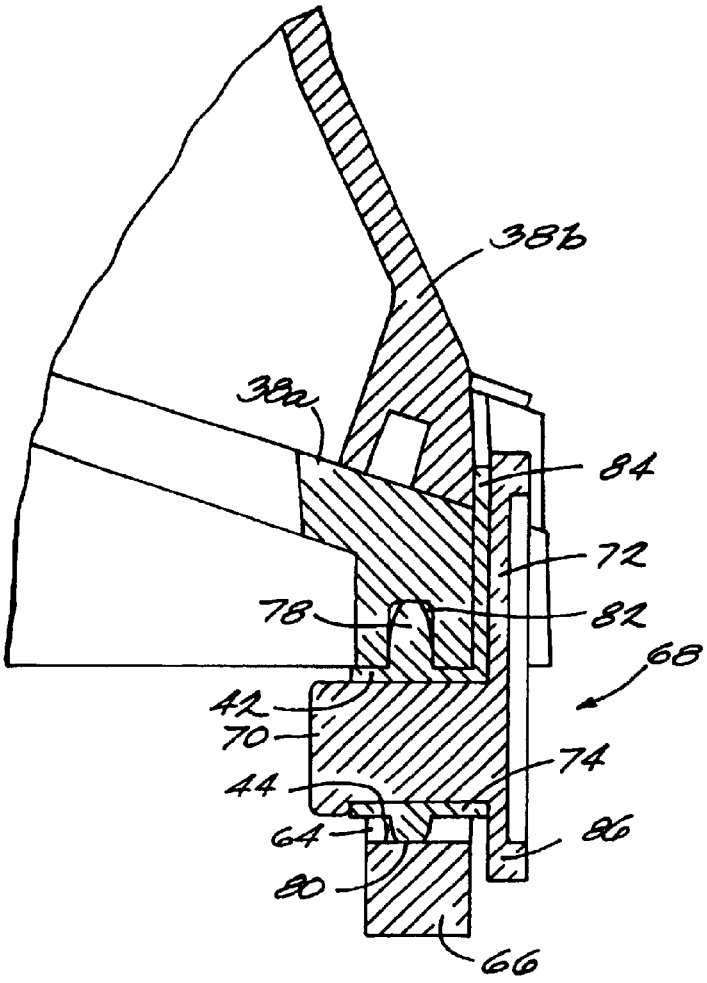
FIG. 4 is section view of the cylinder head and cam cover taken along line IV—IV of FIG. 2.
Figure 5:
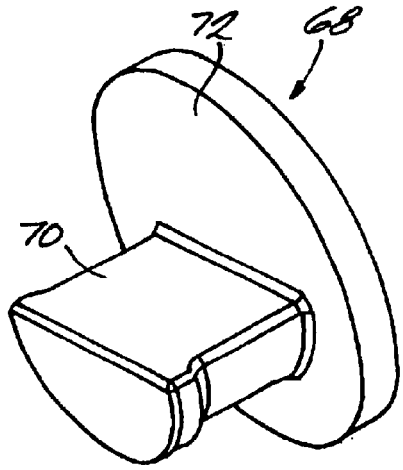
FIG. 5 is a perspective view of a cam end cover of the internal combustion engine.
Figure 6:
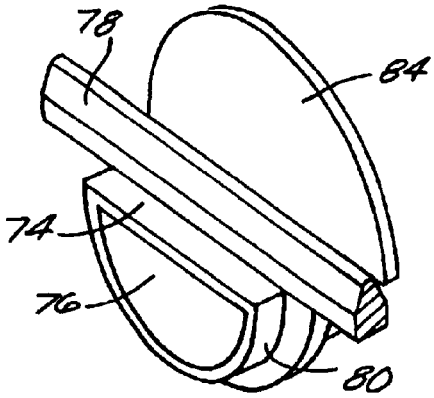
FIG. 6 is a partial perspective view of a cam end seal of the internal combustion engine.

Referring to FIGS. 4–6, effective sealing of the cam case is achieved by providing substantially rigid inserts 68 (FIG. 5) positioned within the apertures 64. The inserts 68 are preferably made of a metal such as aluminum, which has a modulus of elasticity of about 69 GPa ($10\times10^6$ psi), however other metals having different moduli of elasticity are possible. In addition to metals, other substantially rigid fabrication materials (e.g. plastics) having flexural moduli of at least about 1 GPa (150 ksi) are possible as well. In a first embodiment, the inserts 68 include a substantially semi-circular inner portion 70 that is received by the apertures 64. The inner portion 70 has a first arcuate profile that corresponds to the arcuate aperture boundary provided by the cylinder head 34, and a second substantially linear profile that corresponds to the linear aperture boundary provided by the cam cover 36. The inserts 68 also include a substantially circular outer portion 72 that overlies portions of the cylinder head wall 66 and the cam cover 38.

To provide effective sealing around the inserts 68, the sealing gasket 54 includes sealing jackets 74 (FIG. 6) that are adapted to receive and surround the inner portion 70 of the inserts 68. The sealing jacket 74 includes a semi-circular opening 76 that receives the inner portion 70 and a resilient sealing strip 78 that is substantially continuous with the remainder of the sealing gasket 54. A resilient sealing lug 80 extends around the sealing jacket 74 and is substantially continuous with the sealing strip 78. In some embodiments, the lower peripheral edge 42 of the cam cover 38 includes a groove 82 that is adapted to receive the sealing strip 78. The sealing jacket 74 also includes a resilient sealing flange or flap 84 that is positioned between the cam cover 38 and the outer portion 72 of the inserts 68 to further seal the interface and reduce and/or damp vibrations of the outer portion 72 during motorcycle operation.

To seal the apertures 64, the inner portions 70 of each insert 68 are pressed into the openings 76 of the sealing jackets 74 and positioned, along with the sealing gasket 54, between the base cover 38*a* and the cylinder head 34 such that the sealing jackets 74 and the inserts 68 occupy the apertures 64 as illustrated in FIG. 4. Once the sealing gasket 54 and the inserts 68 are properly positioned on the cylinder head 34, the cam cover 38 is secured to the cylinder head 34 using the bolts 46. Thus, the inserts 68 occupy a majority of the apertures 64, and the sealing lugs 80 seal the apertures 64 along the cylinder head 34 and the sealing strips 78, and the sealing flaps 84 seal the apertures 64 along the cam cover 38. For aesthetic purposes, the circular outer portion 72 of the insert 68 includes a raised circumferential collar 86. However, as discussed below, the outer portion 72 may include other aesthetic features as well.

Figure 7:
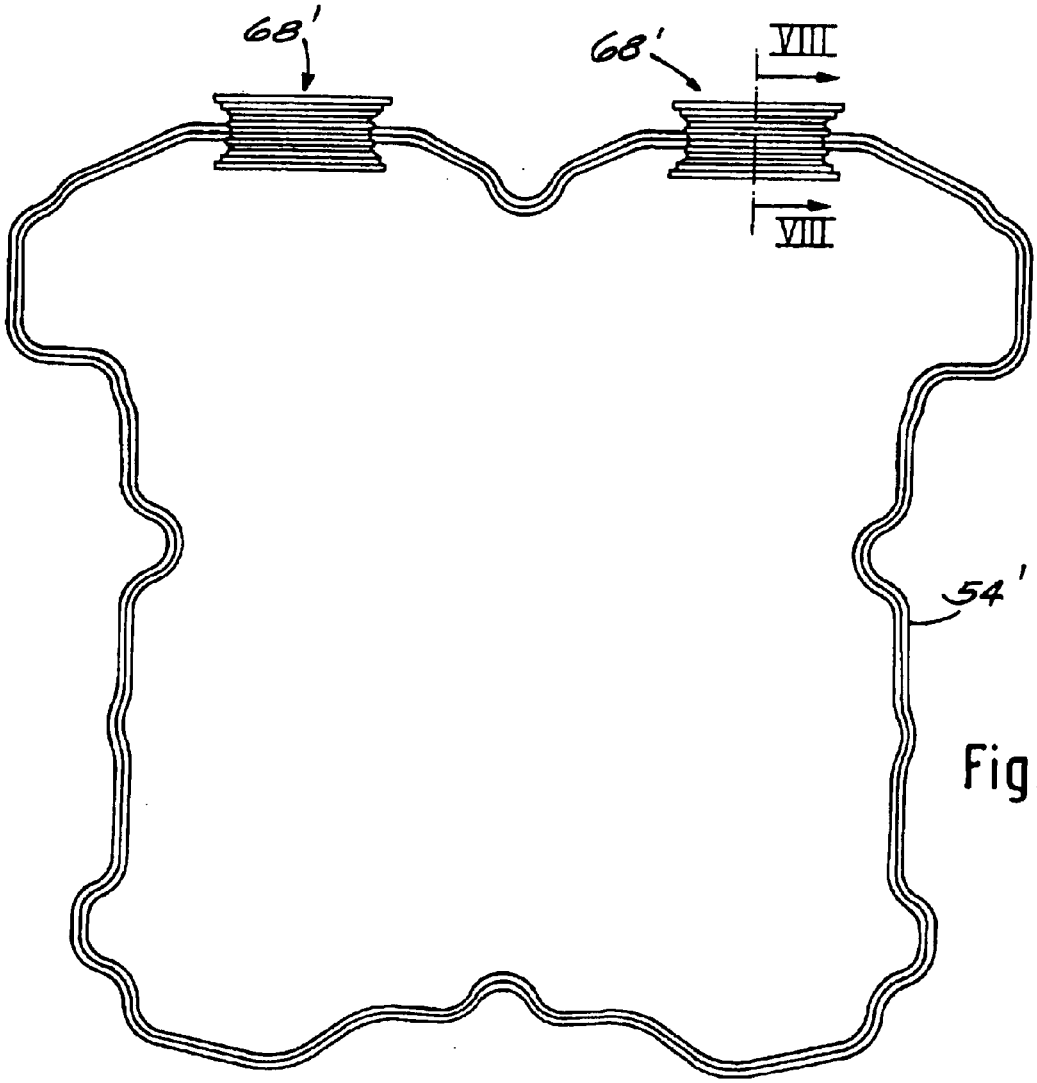
FIG. 7 is a top view of a cam cover seal and cam end cover of the internal combustion engine.
Figure 8:
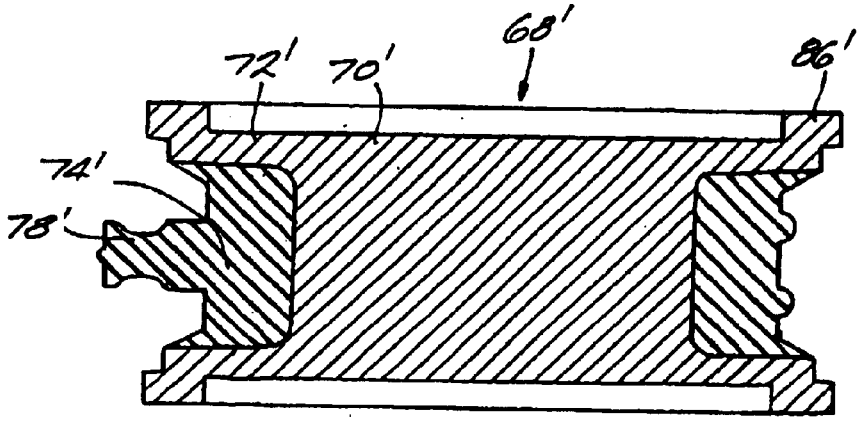
FIG. 8 is a section view taken along line VIII—VIII of FIG. 7.

FIGS. 7 and 8 illustrate a second embodiment of the invention wherein the inserts 68' are substantially uniformly circular. The second embodiment is particularly well suited for a motorcycle having the cam cover 38 fabricated as a unitary piece as mentioned above. In this event, the cam cover 38 is provided with semi-circular apertures that are substantially mirror images of the apertures 64 in the cylinder head 34 and define recesses in the lower peripheral edge 42 of the cam cover 38. The apertures in the cam cover 38 substantially oppose the semi-circular apertures 64 in the cylinder head 34 when the cam cover 38 is mounted to the cylinder head 34. The opposed apertures in the cam cover 38 and the cylinder head 34 thus cooperate to define a single, substantially circular aperture communicating with the cam case.

As illustrated in FIGS. 7 and 8, the sealing gasket 54' may be molded directly around the inserts 68', thereby forming the sealing jacket 74'. It should be appreciated that the previously-described sealing gasket 54 may also be molded directly around the inserts 68. To seal the cam case, the sealing gasket 54' and the inserts 68' are positioned on the upper peripheral edge 44 of the cylinder head 34, and the one piece cam cover 38 is secured to the cylinder head 34 such that circular inner portions 70' of the inserts 68' occupy the circular apertures, much the same way as the semi-circular inner portions 70 occupy the semi-circular apertures 64. Similar to the first embodiment, the sealing jacket 74' includes a sealing strip 78' that seals the aperture along the cam cover 38, and the insert 68' includes a circular outer portion 72' including a raised circumferential collar 86' for aesthetic appeal.

With the construction and arrangement of the embodiments described above, the sealing gasket 54 and the inserts 68 provide for the replacement of the inserts 68 and the gasket 54 either alone or in combination. For example, if an insert 68 becomes damaged, or if it is desired to replace the insert 68 with a new insert 68 or an alternate insert having a different aesthetic appearance, the cam cover 38 is removed from the cylinder head 34 and the gasket 54 and the inserts 68 are removed from the interface. The inserts 68 may then be removed from the openings 76 in the sealing jackets 74 and the new/alternate inserts are then inserted into the openings 76. The gasket 54, including the new/alternate inserts, is then repositioned in the interface and the cam cover 38 is recoupled to the cylinder head 34. Alternatively, if the gasket 54 is worn or damaged but the inserts 68 are otherwise intact, a new gasket, similar to the old gasket 54 may be provided. The new gasket, having the same inserts 68 inserted therein, may then be installed in place of the old gasket 54. Also, inserts 68 having differently shaped or contoured outer portions 72, or outer portions 72 that display various icons or indicia thereon may be provided and installed to customize or otherwise alter the aesthetic appearance of the motorcycle 10. With respect to the examples given above, the gasket 54 and insert 68 assembly potentially reduces the cost of replacing a worn, damaged, or otherwise unwanted gasket 54 or insert 68 because the components may be replaced independently of each other.

While the forgoing description has been presented with respect to an overhead cam V-twin engine, it should be appreciated that the teachings of the present invention are applicable to substantially any engine type requiring the sealing of apertures that may be positioned along various engine interfaces.

Various features of the invention are set forth in the following claims.

What is claimed is:

1. A motorcycle comprising:

a frame;

an engine crankcase and cylinder assembly coupled to the frame;

a cylinder head coupled to the crankcase and cylinder assembly and including a camshaft support surface and a cylinder head wall, the camshaft support surface defining a camshaft axis and the cylinder head wall partially defining an aperture that is substantially axially aligned with the camshaft axis;

a cam cover coupled to the cylinder head and cooperating with the cylinder head wall to further define the aperture; and a substantially rigid insert positioned in the aperture; and a sealing jacket that surrounds the insert and engages the cylinder head and the cam cover.

2. The motorcycle of claim 1, wherein the aperture is substantially semi-circular and the insert includes a substantially semi-circular inner portion received by the aperture.

3. The motorcycle of claim 1, wherein the aperture is substantially circular and the insert includes a substantially circular inner portion received by the aperture.

4. The motorcycle of claim 1, wherein the sealing jacket is integrally formed with a resilient sealing member positioned between the cylinder head and the cam cover.

5. The motorcycle of claim 1, wherein the insert includes a substantially circular outer portion that overlies portions of the cylinder head wall and the cam cover.

6. The motorcycle of claim 5, wherein the sealing jacket includes a flap portion positioned between the cam cover and the circular outer portion.

7. The motorcycle of claim 1, wherein the insert includes a substantially circular outer portion that overlies the cylinder head wall and the cam cover.

8. The motorcycle of claim 1, wherein the aperture includes a first boundary defined by the cylinder head and a second boundary defined by the cam cover, and the insert includes a first profile corresponding to the first boundary, and a second profile corresponding to the second boundary.

9. The motorcycle of claim 8, wherein the first and second profiles cooperate to define a semi-circular inner portion of the insert.

10. The motorcycle of claim 8, wherein the first and second profiles cooperate to define a circular inner portion of the insert.

11. A method for sealing an interface between a cylinder head and a cam cover, the cylinder head including a camshaft support surface defining a camshaft axis and a cylinder head wall defining an aperture, the aperture being adjacent the interface and substantially aligned with the camshaft axis, the method comprising:

providing a substantially rigid insert;

positioning a resilient sealing member including a resilient sealing jacket around the insert; and locating the resilient sealing member between the cylinder head and the cam cover such that the resilient sealing jacket and the insert occupy the aperture.

12. The method of claim 11, wherein the jacket includes an opening and positioning the resilient sealing member around the insert includes inserting a portion of the insert into the opening.

13. The method of claim 11, wherein locating the sealing member between the cylinder head and the cam cover includes positioning a substantially circular outer portion of the insert in overlying relation to portions of at least one of the cylinder head and the cam cover.

14. The method of claim 11, wherein locating the resilient sealing member between the cylinder head and the cam cover includes positioning a flap portion of the sealing jacket between an outer circular portion of the insert and the cam cover.

15. A sealing gasket and insert assembly for sealing an interface between a cylinder head and a cam cover of an overhead cam motorcycle engine, the sealing gasket and insert assembly comprising:

a resilient sealing gasket positionable within the interface and including a sealing jacket; and a substantially rigid insert surrounded by and coupled to the sealing jacket.

16. The sealing gasket and insert assembly of claim 15, wherein the insert includes an outer portion positionable in overlying relation to portions of at least one of the cylinder head and the cam cover.

17. The sealing gasket and insert assembly of claim 15, wherein the sealing jacket is molded around the insert.

18. The sealing gasket and insert assembly of claim 15, wherein the sealing jacket includes an opening and the insert is positioned in the opening.

19. The sealing gasket and insert assembly of claim 15, wherein the insert further includes a substantially semi-circular inner portion.

20. A method of making a sealing gasket and insert assembly for an overhead cam motorcycle engine, the method comprising:

providing a rigid insert;

providing a sealing gasket including a sealing jacket, the sealing jacket defining an opening; and positioning the sealing gasket around the insert such that the sealing jacket substantially surrounds and retains the insert.

21. The method of claim 20, wherein positioning the sealing gasket around the insert includes molding the gasket around the insert.

22. The method of claim 20, wherein positioning the sealing gasket around the insert includes pressing the insert into the opening.

23. The method of claim 20, wherein the sealing jacket includes a flap portion, and wherein positioning the insert within the opening includes positioning an outer circular portion of the insert adjacent to the flap portion.

24. A method for replacing a substantially rigid old insert having an inner portion received by an opening in a sealing gasket, the sealing gasket positioned in an interface between a cylinder head and a cam cover of an overhead cam motorcycle engine, the method comprising:

providing a substantially rigid replacement insert including an inner portion positionable within the opening;

removing the old insert from the opening; and inserting the replacement insert into the opening.

25. The method of claim 24, wherein the old insert has an outer portion overlying portions of at least one of the cylinder head and the cam cover, and wherein inserting the replacement insert into the opening includes positioning an outer portion of the replacement insert in overlying relation to portions of at least one of the cylinder head and cam cover.

26. The method of claim 24, wherein removing the old insert includes decoupling the cam cover from the cylinder head and removing the sealing gasket from the interface.

27. The method of claim 24, further comprising providing a replacement sealing gasket including an opening and positioning the replacement sealing gasket in the interface.

28. The method of claim 24, further comprising aligning the replacement insert with a camshaft axis of the cylinder head.

29. A method for replacing a sealing gasket positioned in an interface between a cylinder head and a cam cover of an overhead cam motorcycle engine, the sealing gasket including an opening that receives an inner portion of a substantially rigid insert, the insert having an outer portion overlying portions of at least one of the cylinder head and the cam cover, the method comprising:

decoupling the cam cover from the cylinder head;

removing the sealing gasket from the interface;

removing the insert from the sealing gasket opening;

providing a replacement sealing gasket including an opening configured to receive the inner portion of the insert;

inserting the inner portion into the opening of the replacement gasket;

positioning the replacement gasket in the interface; and recoupling the cam cover to the cylinder head.

30. The method of claim 29, wherein inserting the inner portion into the opening of the replacement gasket includes positioning an outer portion of the insert in overlying relation to portions of the cylinder head and cam cover.

31. The method of claim 29, further comprising providing a replacement insert including an inner portion receivable by the opening of the replacement gasket.

32. The method of claim 29, further comprising aligning the insert with a camshaft axis of the cylinder head.

* * * * *

UNITED STATES PATENT AND TRADEMARK OFFICE

CERTIFICATE OF CORRECTION

PATENT NO. : 6,701,884 B2 
DATED : March 9, 2004
INVENTOR(S) : Andreas Schneider, Klaus Fuoss and Jeffrey P. Coughlin It is certified that error appears in the above-identified patent and that said Letters Patent is hereby corrected as shown below:

Title page,
Item [56], References Cited, U.S. PATENT DOCUMENTS, insert the following:

| | | | |
|---|---|---|---|
| -- | DE | 3329418 | 02/1985 |
| | DE | 3831415 | 03/1990 |
| | DE | 3831413 | 04/1990 |
| | EP | 0510304 | 10/1992 |
| | JP | 5288117 | 11/1993 |
| | DE | 4230710 | 03/1994 |
| | DE | 19538904 | 11/1996 |
| | DE | 19722629 | 12/1998 -- |

Signed and Sealed this

Twenty-ninth Day of June, 2004

JON W. DUDAS
*Acting Director of the United States Patent and Trademark Office*